US005997410A

United States Patent [19]

Nothdurft

[11] Patent Number: 5,997,410

[45] Date of Patent: Dec. 7, 1999

[54] GOLF TRAINING DEVICE

[76] Inventor: Karl F. Nothdurft, 7 Windemere, Grosse Pointe Farms, Mich. 48236

[21] Appl. No.: 09/161,363

[22] Filed: Sep. 28, 1998

[51] Int. Cl.[6] ..... A63B 69/36

[52] U.S. Cl. ..... 473/258; 473/270

[58] Field of Search ..... 473/258, 270

[56] References Cited

U.S. PATENT DOCUMENTS

| | | | |
|---|---|---|---|
| 4,900,030 | 2/1990 | Houtz | 473/258 |
| 5,586,945 | 12/1996 | Vonderhaar | 473/258 |
| 5,658,204 | 8/1997 | Nappi | 473/258 X |

*Primary Examiner*—George J. Marlo
*Attorney, Agent, or Firm*—William L. Fisher

[57] ABSTRACT

Improvement in a golf training device having a guide bar having a horizontally disposed straight portion thereof for guiding the back and forth movement of the shaft of a golf club while a golfer practices therewith, the improvement being in the arrangement supporting the guide bar, such arrangement utilizing the weight of the golfer to steady the position thereof during use of the golf training device and including a foot mat upon which the golfer can stand, the foot mat having top and bottom surfaces, a straight front edge and front corners at opposite ends of the front edge, a pair of support structures at such front corners, respectively, which upstand from the top surface of the foot mat for gripping opposite ends of the guide bar, respectively, to hold it in place, the support structures holding the straight portion of the guide bar bar disposed above such top surface and forwardly of such front edge, the golfer being able to stand upon the foot mat behind the pair of support structures, whereby his weight steadies the position of the guide bar during use of the golf training device.

2 Claims, 3 Drawing Sheets

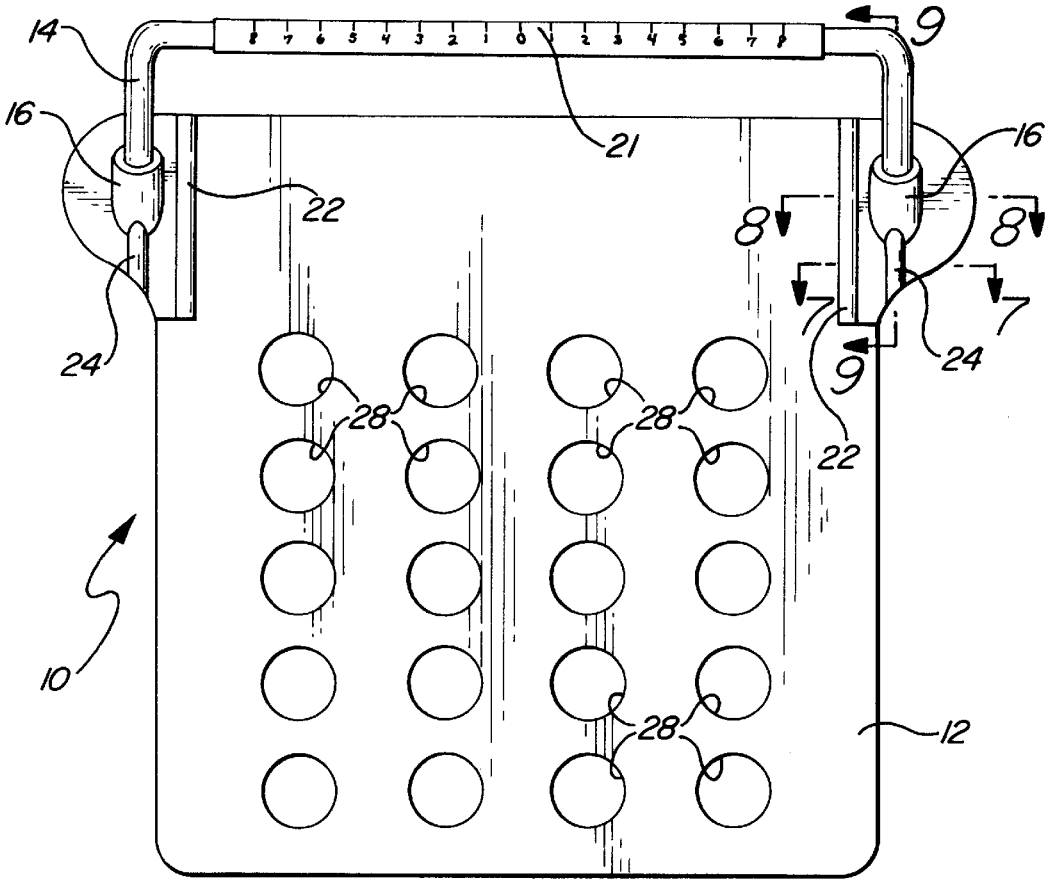
FIG-2
FIG-3
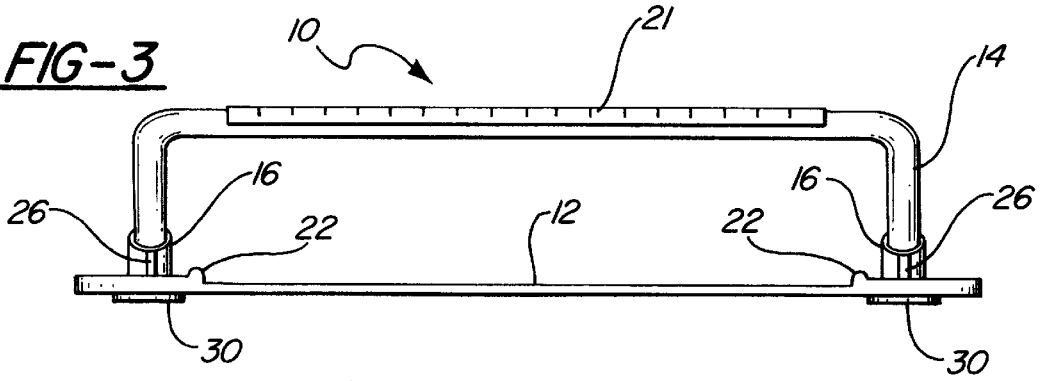
FIG-4
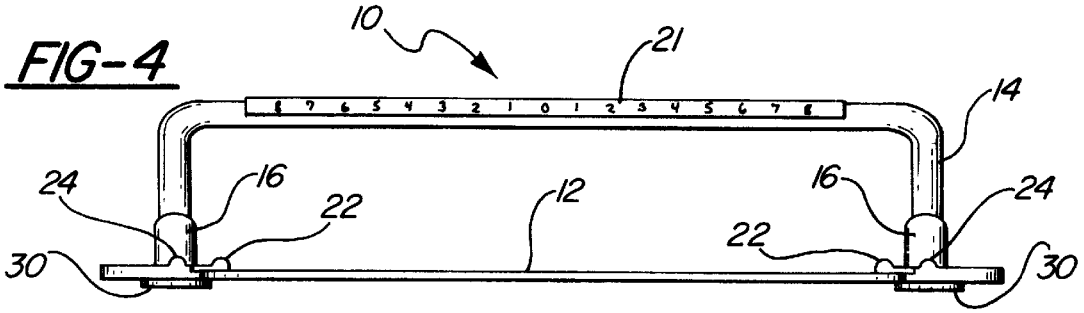

FIG-5
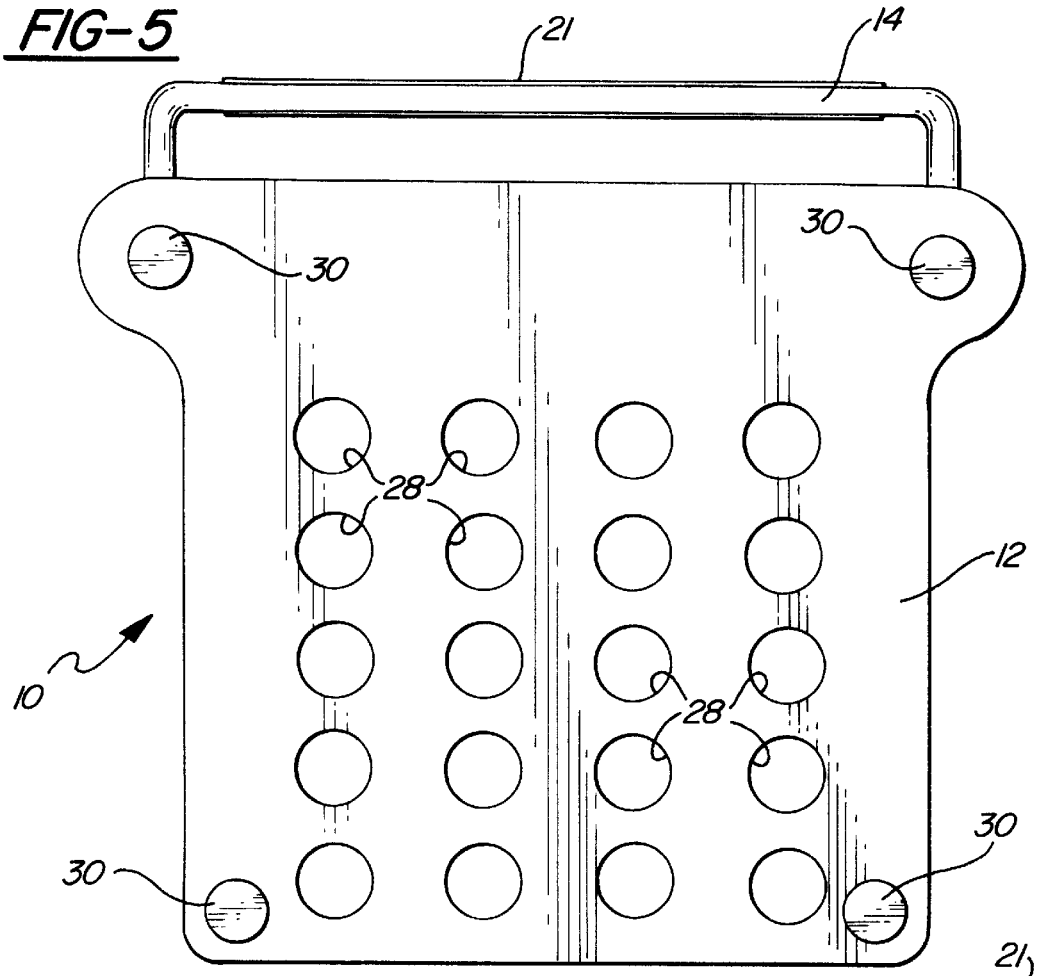
FIG-6
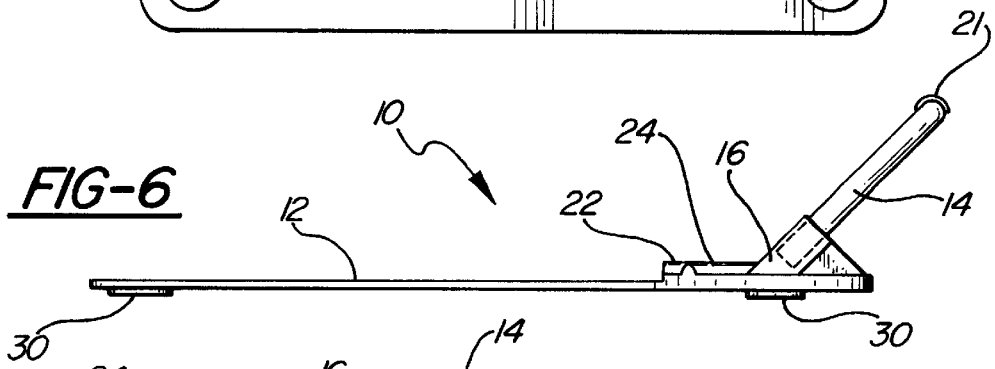
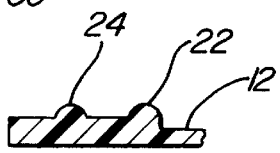
FIG-7
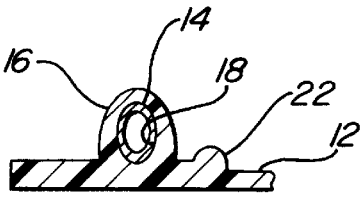
FIG-8
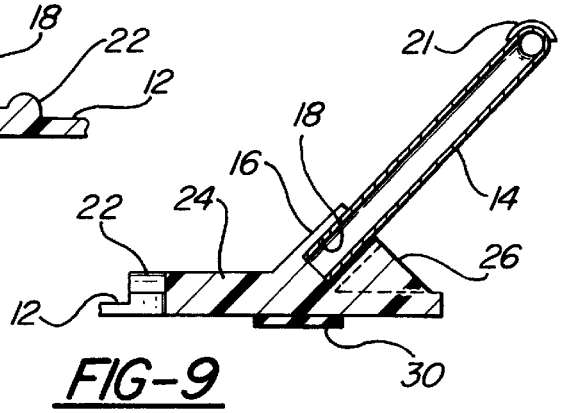
FIG-9

GOLF TRAINING DEVICE

My invention relates to the game of golf and more particularly to that part thereof played on greens and just off greens, called putting and chipping, respectively.

The principal object of my invention is the provision of an improvement in golf training devices as herein shown and described.

The forgoing object of my invention will become apparent during the course of the following description, taken in conjunction with the accompanying drawings, in which:

FIG. 2 is a top plan view of said golf training device;

FIG. 3 is a front elevational view thereof;

FIG. 4 is a rear elevational view thereof;

FIG. 5 is a bottom plan view thereof;

FIG. 6 is a right side elevational view thereof; and

FIGS. 7–9 are vertical sectional views, on an enlarged scale, of the structure of FIG. 2, taken, respectively, on the lines 7—7; 8—8; and 9—9 thereof.

Figure 1:
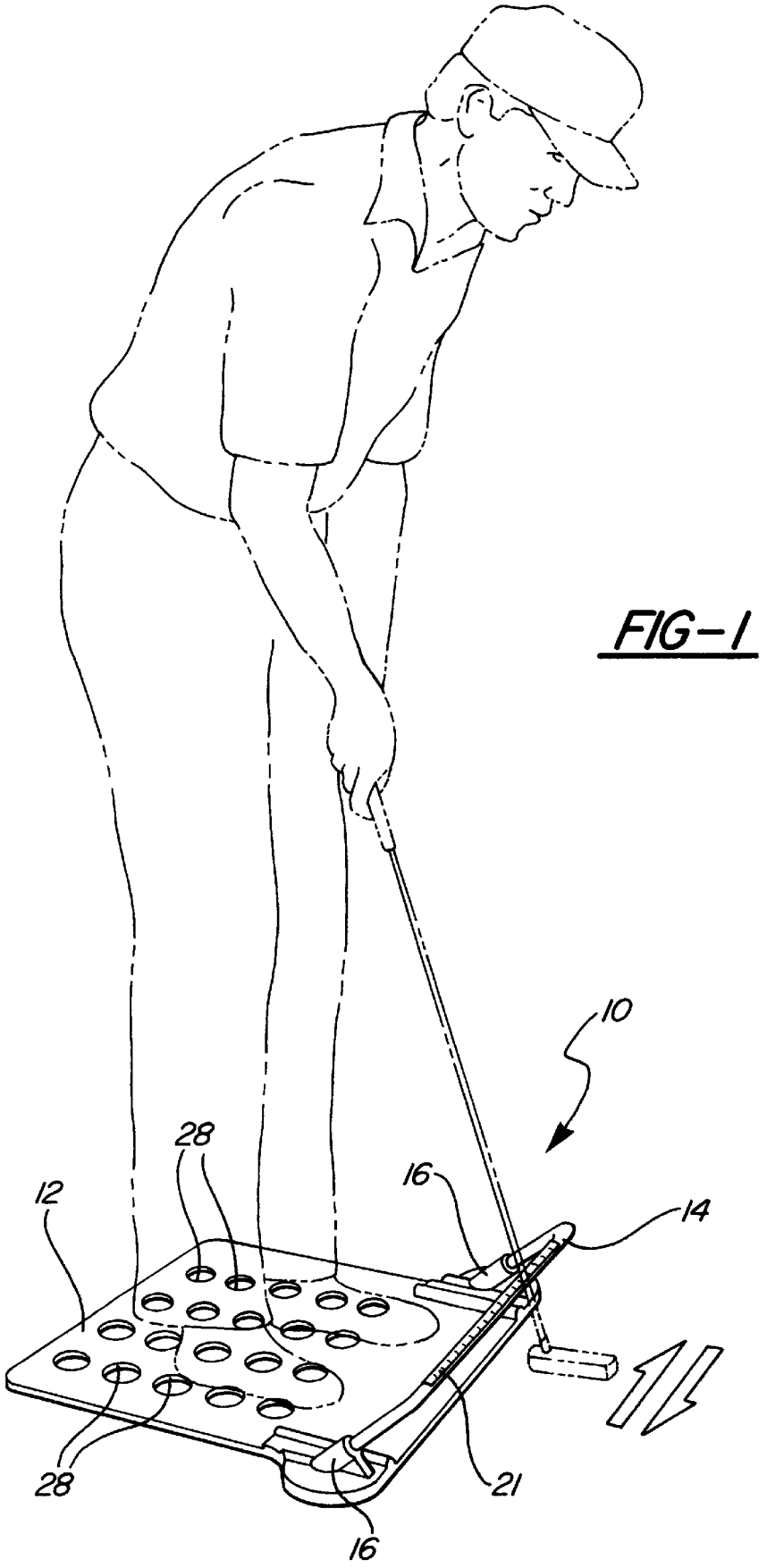
FIG. 1 is a perspective view of a golf training device embodying my invention shown in use by a golfer practicing a putting stroke.

My golf training device is an improvement over prior art golf training devices, particularly over the putting stroke training device shown and described in U.S. Pat. No. 4,900,030 issued to Bradley L. Houtz on Feb. 13, 1990. The Houtz putting stroke training device is intended to be used by a golfer to practice putting strokes to improve his or her putting ability. It uses a guide bar that has curved portions for guiding the putting stroke in circular arcs at the back and front thereof. For a right handed golfer, the curvature of the guide bar at the back-stroke is greater than that at the front-stroke so that the training device must be taken apart and then reassembled to enable a left handed golfer to use it. The Houtz device has a built-in problem of wobbliness with its resting upon a surface without being steadied and because of its many articulating members. On the other hand, my golf training device uses the weight of a golfer standing upon a foot mat to steady its guide bar during use thereof. It is also more efficient as a golf training device and simpler to make and use.

Referring to the drawings in greater detail, 10 generally designates my golf training device which comprises a foot mat 12 on which a golfer stands and a guide bar 14 held in place by the foot mat 12. The foot mat 12 is injected molded of suitable plastic or rubber. The guide bar 14 is formed of tubular steel or tubular plastic and has an elongated straight portion and opposite ends thereof bent at right angles to the straight portion. A pair of bosses 16 are integrally molded with the body of the foot mat 12 at the front corners thereof and upstand from the top surface thereof at a 45 degree angle to the plane thereof. The opposite ends of the guide bar 14 are embedded, respectively, in the bosses 16 which are provided with blind apertures 18 therein for receiving such ends. The guide bar 14 is held so that the straight portion thereof is disposed horizontally above the foot mat 12 and forwardly of the front edge thereof. Such straight portion is provided with an adhesive strip 21 of suitable plastic having numbering thereon to mark the center of such straight portion and equidistant locations on opposite sides of such center (8–0 on one side and 0–8 on the other) to enable the golfer to gauge the length of his or her practice putting or chipping stroke. The mat 12 is provided with reinforcing at the two front corners thereof by molding such corners of double height wall thicknesses. Longitudinally extending ribs 22 and 24 of triple height wall thicknesses are formed within the confines of the front corners to further reinforce the foot mat 12. Still further reinforcement consists of a pair of integrally molded gussets 26 joining, respectively, the front walls of the bosses 16 and the body of the foot mat 12. To assist the foot mat 12 to stay in place upon a surface upon which it is laid, the rear portion thereof is provided with a plurality of through-apertures 28 which extend through the wall thickness of such rear portion. Grass or carpeting can protrude through the apertures 28 to give the feet of the golfer a feel for such surface. In addition, rubber or Velcro (a trademark) pads 30 are provided on the undersurface of the foot mat 12 at the four corners thereof to keep same from slipping on any smooth surface upon which it is laid. The apertures 28 are arranged in longitudinal and transverse rows; the transverse rows form a sight guide to assist the golfer in arranging his or her feet parallel to the straight portion of the guide bar 14 for addressing same.

In use of the training device 10, either a left-handed or a right-handed golfer can use same equally well and handily. The golfer stands upon the foot mat 12 and uses the straight portion of the guide bar 14 to guide his or her club shaft back and forth in a straight line during putting or chipping practice. The weight of the golfer upon the foot mat 12 is used to steady the position of the guide bar 14 during use of the training device 10.

I have selected a trademark by which I desire my golf training device to be known and that is: "PUTT-MASTER". In spite of the trademark I have selected, my training device 10 can be used to practice chipping strokes as well as putting strokes, as mentioned.

It will thus be seen that there has been provided by my invention an improved golf training device in which the object hereinabove set forth has been successfully achieved. While a preferred embodiment of my invention has been shown and described, it is to be understood that changes and variations thereof may be made without departing from the spirit of my invention as defined by the appended claims.

What I claim is:

1. Improvement in a golf training device having a guide bar having a horizontally disposed straight portion thereof for guiding the back and forth movement of the shaft of a golf club while a golfer practices therewith, said improvement being in in the means supporting the guide bar, said means utilizing the weight of the golfer to steady the position of the guide bar during use of the golf training device and including a foot mat upon which the golfer can stand, the foot mat having top and bottom surfaces, a straight front edge and front corners at opposite ends of said front edge, a pair of support structures at said front corners, respectively, which upstand from said top surface for gripping opposite ends of the guide bar, respectively, to hold it in place, said support structures holding the straight portion of the guide bar disposed above said top surface and forwardly of said front edge, the golfer being able to stand upon the foot mat behind the pair of support structures, whereby his weight steadies the position of the guide bar during use of the golf training device.

2. Improvement in a golf training device as claimed in claim 1 in which the portion of the foot mat behind the pair of support structures upon which the golfer stands is provided with a plurality of through-apertures extending through the wall thickness of the foot mat between the top and bottom surfaces thereof, said apertures serving as a sight guide to assist the golfer in addressing the straight portion of the guide bar, said apertures also assisting the foot mat to stay in place upon a surface upon which it may be laid.

* * * * *